US006884117B2

(12) United States Patent
Korsunsky et al.

(10) Patent No.: US 6,884,117 B2
(45) Date of Patent: Apr. 26, 2005

(54) ELECTRICAL CONNECTOR HAVING CIRCUIT BOARD MODULES POSITIONED BETWEEN METAL STIFFENER AND A HOUSING

(75) Inventors: Iosif R. Korsunsky, Harrisburg, PA (US); Chong H. Yi, Mechanicsburg, PA (US); Tod M. Harlan, Mechanicsburg, PA (US); Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/728,438

(22) Filed: Dec. 5, 2003

(65) Prior Publication Data

US 2005/0048838 A1 Mar. 3, 2005

Related U.S. Application Data

(63) Continuation-in-part of application No. 10/651,932, filed on Aug. 29, 2003.

(51) Int. Cl.[7] ..... H01R 13/648
(52) U.S. Cl. ..... 439/607; 439/76.1
(58) Field of Search ..... 439/607, 608, 439/76.1, 67, 108, 701, 79, 638, 650

(56) References Cited

U.S. PATENT DOCUMENTS 5,672,064 A 9/1997 Provencher et al.
5,702,258 A 12/1997 Provencher et al.
5,980,321 A 11/1999 Cohen et al.
6,146,202 A * 11/2000 Ramey et al. ..... 439/608
6,152,747 A * 11/2000 McNamara ..... 439/108
6,168,469 B1 * 1/2001 Lu ..... 439/608
6,171,115 B1 * 1/2001 Mickievicz et al. ..... 439/76.1
6,174,202 B1 * 1/2001 Mitra ..... 439/608
6,196,853 B1 * 3/2001 Harting et al. ..... 439/79
6,231,391 B1 * 5/2001 Ramey et al. ..... 439/608
6,238,245 B1 * 5/2001 Stokoe et al. ..... 439/608
6,267,604 B1 * 7/2001 Mickievicz et al. ..... 439/79
6,293,827 B1 * 9/2001 Stokoe ..... 439/608
6,299,483 B1 * 10/2001 Cohen et al. ..... 439/608
6,315,605 B1 * 11/2001 Billman et al. ..... 439/540.1
6,322,379 B1 * 11/2001 Ortega et al. ..... 439/108
6,328,602 B1 * 12/2001 Yamasaki et al. ..... 439/608
6,343,955 B1 * 2/2002 Billman et al. ..... 439/608
6,347,962 B1 * 2/2002 Kline ..... 439/608
6,354,877 B1 * 3/2002 Shuey et al. ..... 439/608
6,361,366 B1 * 3/2002 Shuey et al. ..... 439/608

(Continued)

*Primary Examiner*—Ross Gushi
(74) *Attorney, Agent, or Firm*—Wei Te Chung

(57) ABSTRACT

An electrical connector (100) includes a unitary insulative housing (1) including a base (10) defining a number of parallel slots (13) and a first shroud (11) extending forwardly from the base, a number of parallelly arranged circuit board modules (3) and a metal stiffener (2) attached to the housing. The circuit board modules are retained by and between the metal stiffener and the housing. Each circuit board module includes a dielectric spacer (30), a circuit board (36) attached to the dielectric spacer and received in a corresponding slot of the housing, and a row of press-fit contacts (38) mechanically and electrically connecting with the circuit board. The metal stiffener includes a second shroud (201) vertically spaced from the first shroud. The circuit boards have mating portions (362) disposed between the first and the second shrouds.

21 Claims, 10 Drawing Sheets

U.S. PATENT DOCUMENTS 6,364,710 B1 * 4/2002 Billman et al. ..... 439/608
6,371,773 B1 * 4/2002 Crofoot et al. ..... 439/79
6,371,788 B1 * 4/2002 Bowling et al. ..... 439/358
6,371,813 B1 * 4/2002 Ramey et al. ..... 439/608
6,375,508 B1 * 4/2002 Pickles et al. ..... 439/608
6,379,188 B1 * 4/2002 Cohen et al. ..... 439/608
6,386,924 B1 * 5/2002 Long ..... 439/701
6,390,857 B1 * 5/2002 Pickles et al. ..... 439/680
6,394,822 B1 * 5/2002 McNamara ..... 439/108
6,409,543 B1 * 6/2002 Astbury et al. ..... 439/608
6,431,914 B1 * 8/2002 Billman ..... 439/608
6,435,913 B1 * 8/2002 Billman ..... 439/608
6,435,914 B1 * 8/2002 Billman ..... 439/608
6,461,202 B1 * 10/2002 Kline ..... 439/701
6,471,549 B1 * 10/2002 Lappohn ..... 439/608
6,475,023 B1 * 11/2002 Carneling ..... 439/488
6,478,624 B1 * 11/2002 Ramey et al. ..... 439/608
6,500,029 B1 * 12/2002 Nitta ..... 439/608
6,503,103 B1 * 1/2003 Cohen et al. ..... 439/608
6,506,076 B1 * 1/2003 Cohen et al. ..... 439/608
6,514,103 B1 * 2/2003 Pape et al. ..... 439/608
6,517,360 B1 * 2/2003 Cohen ..... 439/65
6,520,803 B1 * 2/2003 Dunn ..... 439/608
6,530,790 B1 * 3/2003 McNamara et al. ..... 439/108
6,537,087 B1 * 3/2003 McNamara et al. ..... 439/108
6,540,522 B1 * 4/2003 Sipe ..... 439/61
6,540,558 B1 * 4/2003 Paagman ..... 439/608
6,544,046 B1 * 4/2003 Hahn et al. ..... 439/83
6,544,072 B1 * 4/2003 Olson ..... 439/608
6,551,140 B1 * 4/2003 Billman et al. ..... 439/608
6,554,647 B1 * 4/2003 Cohen et al. ..... 439/607
6,572,410 B1 * 6/2003 Volstorf et al. ..... 439/608
6,579,124 B1 * 6/2003 Vanbesien ..... 439/608
6,592,381 B1 * 7/2003 Cohen et al. ..... 439/80
6,602,095 B1 * 8/2003 Astbury et al. ..... 439/608
6,607,402 B1 * 8/2003 Cohen et al. ..... 439/608
6,612,869 B1 * 9/2003 Billman ..... 439/608
6,623,302 B1 * 9/2003 Billman et al. ..... 439/608
6,623,310 B1 * 9/2003 Billman et al. ..... 439/701
6,634,908 B1 * 10/2003 Billman et al. ..... 439/608
6,638,079 B1 * 10/2003 Billman et al. ..... 439/76.1
6,638,110 B1 * 10/2003 Billman ..... 439/608
6,641,438 B1 * 11/2003 Billman ..... 439/608
6,645,009 B1 * 11/2003 Billman et al. ..... 439/608
6,645,010 B1 * 11/2003 Billman et al. ..... 439/608
6,648,687 B1 * 11/2003 Otto et al. ..... 439/607
6,648,689 B1 * 11/2003 Billman et al. ..... 439/608
6,652,319 B1 * 11/2003 Billman ..... 439/608
6,655,966 B1 * 12/2003 Rothermel et al. ..... 439/76.1
6,659,808 B1 * 12/2003 Billman et al. ..... 439/680
6,663,401 B1 * 12/2003 Billman et al. ..... 439/76.1
6,663,426 B1 * 12/2003 Fedder et al. ..... 439/608
6,663,427 B1 * 12/2003 Billman et al. ..... 439/608
6,663,429 B1 * 12/2003 Korsunsky et al. ..... 439/608
6,666,692 B1 * 12/2003 Billman et al. ..... 439/76.1
6,672,886 B1 * 1/2004 Billman ..... 439/82
6,676,450 B1 * 1/2004 Schroll ..... 439/608
6,682,369 B1 * 1/2004 Korsunsky et al. ..... 439/608
6,685,488 B1 * 2/2004 Billman et al. ..... 439/108
6,692,272 B1 * 2/2004 Lemke et al. ..... 439/108
6,692,305 B1 * 2/2004 Nelson et al. ..... 439/608
6,695,627 B1 * 2/2004 Ortega et al. ..... 439/78
6,699,072 B1 * 3/2004 Wu ..... 439/608
6,699,073 B1 * 3/2004 Wu ..... 439/608
6,709,298 B1 * 3/2004 Bradley ..... 439/701
6,712,646 B1 * 3/2004 Shindo ..... 439/608
6,739,910 B1 * 5/2004 Wu ..... 439/608
6,739,918 B1 * 5/2004 Cohen et al. ..... 439/701
6,743,050 B1 * 6/2004 Wu ..... 439/608
6,743,057 B1 * 6/2004 Davis et al. ..... 439/701
6,746,278 B1 * 6/2004 Nelson et al. ..... 439/608
6,749,468 B1 * 6/2004 Avery ..... 439/701
6,764,320 B1 * 7/2004 Lenoir et al. ..... 439/101
6,764,349 B1 * 7/2004 Provencher et al. ..... 439/701
6,769,935 B1 * 8/2004 Stokoe et al. ..... 439/608
6,773,305 B1 * 8/2004 Wu ..... 439/608
6,776,629 B1 * 8/2004 Shuey ..... 439/108
6,776,649 B1 * 8/2004 Pape et al. ..... 439/485
6,776,659 B1 * 8/2004 Stokoe et al. ..... 439/608
6,780,058 B1 * 8/2004 Mizumura et al. ..... 439/608
6,780,059 B1 * 8/2004 Payne et al. ..... 439/608
6,790,088 B1 * 9/2004 Ono et al. ..... 439/607
6,790,089 B1 * 9/2004 Wu ..... 439/608

* cited by examiner

ELECTRICAL CONNECTOR HAVING CIRCUIT BOARD MODULES POSITIONED BETWEEN METAL STIFFENER AND A HOUSING

CROSS-REFERENCE TO RELATED APPLICATIONS

This patent application is a continuation-in-part (CIP) of U.S. patent application Ser. No. 10/651,932 filed on Aug. 29, 2003 and entitled "ELECTRICAL CONNECTOR HAVING ENHANCED ELECTRICAL PERFORMANCE", and relates to a contemporaneously filed application having the same applicants and the same assignee with the instant application and titled "ELECTRICAL CONNECTOR WITH CIRCUIT BOARD MODULE".

BACKGROUND OF THE INVENTION

1. Field of the Invention

The present invention relates to an electrical connector, and particularly to a high speed electrical connector having plural circuit board modules.

2. Description of Related Art

With the development of communication and computer technology, high density electrical connectors with conductive elements in a matrix arrangement are desired to construct a large number of signal transmitting paths between two electronic devices. Such high density electrical connectors are widely used in internal connecting systems of severs, routers and the like requiring high speed data processing and communication.

U.S. Pat. Nos. 6,171,115 and 6,267,604 each disclose a high-speed electrical connector having plural individual circuit boards. The connector comprises a two-piece insulative housing consisting of a front housing portion and an organizer attached to the front housing portion to retain the plural individual circuit boards therebetween. The front housing portion includes a front wall having a plurality of parallel apertures extending therethrough, and upper and lower shrouds extending forwardly from the front wall. Each of the upper and the lower shrouds has plural grooves aligned with respective ones of the apertures. The organizer has a plurality of spaced slots located corresponding to the apertures, and a plurality of openings communicating with the slots in a bottom wall thereof. The circuit boards have mating portions extending through the apertures of the front housing portion for mating with a complementary connector, and mounting edges received in the slots of the organizer. The mounting edges of the circuit boards have a plurality of terminals secured thereon by soldering. The terminals extend through respective openings of the organizer for electrically connecting with a circuit substrate.

However, forming a two-piece insulative housing to hold the circuit board modules is complicated, thus increasing the manufacturing cost. Further, to protect the electrical connector from EMI (Electro Magnetic Interference), an additional EMI shielding member must be provided, which also increases the manufacturing cost.

U.S. Pat. Nos. 5,672,064, 5,702,258 and 5,980,321 disclose an alternative approach to form connectors by using a metal stiffener.

U.S. Pat. No. 5,702,258 discloses a modular electrical connector comprising a metal stiffener and a plurality of contact modules attached to the metal stiffener. Each contact module includes an insulative housing having a first and a second shroud portions integrally formed therewith to aid in the insertion of a mating connector.

U.S. Pat. No. 5,980,321 discloses a high-speed electrical connector comprises a plurality of wafers side-by-side stacked and a metal stiffener holding the wafers in a required position. Each wafer is made in two pieces, a shield piece and a signal piece. The shield piece is formed by insert molding housing around a front portion thereof. The signal piece is made by insert molding housing around contacts. In order to hold each wafer in the required position without rotation, three connection points are established between the metal stiffener and the wafer. The connection comprises projections formed on the wafer and corresponding slots defined in the stiffener. However, the projections must be accurately aligned with corresponding slots, respectively, thereby increasing the difficulty of assembling the connector. Further, the arrangement of positioning the shield pieces between the adjacent signal pieces reduces the effective signal density.

Hence, an electrical connector having improved metal stiffener is required to overcome the disadvantages of the related art.

SUMMARY OF THE INVENTION

Accordingly, a first object of the present invention is to provide a high density electrical connector having an improved metal stiffener to simplify positioning circuit board modules.

A second object of the present invention is to provide a high density electrical connector having an improved metal stiffener to ensure a guiding insertion of a mating connector.

In order to achieve the objects set forth, a high density electrical connector in accordance with the present invention comprises a unitary insulative housing including a base defining a plurality of parallel slots and a first shroud extending forwardly from the base, a plurality of parallelly arranged circuit board modules and a metal stiffener attached to the housing. The circuit board modules are retained by and between the metal stiffener and the housing. Each circuit board module includes a dielectric spacer, a circuit board attached to the dielectric spacer and received in a corresponding slot of the housing, and a row of contacts mechanically and electrically connecting with the circuit board and disposed in the corresponding slot. The metal stiffener includes a second shroud vertically spaced from the first shroud. The circuit boards have mating portions disposed between the first and the second shrouds.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
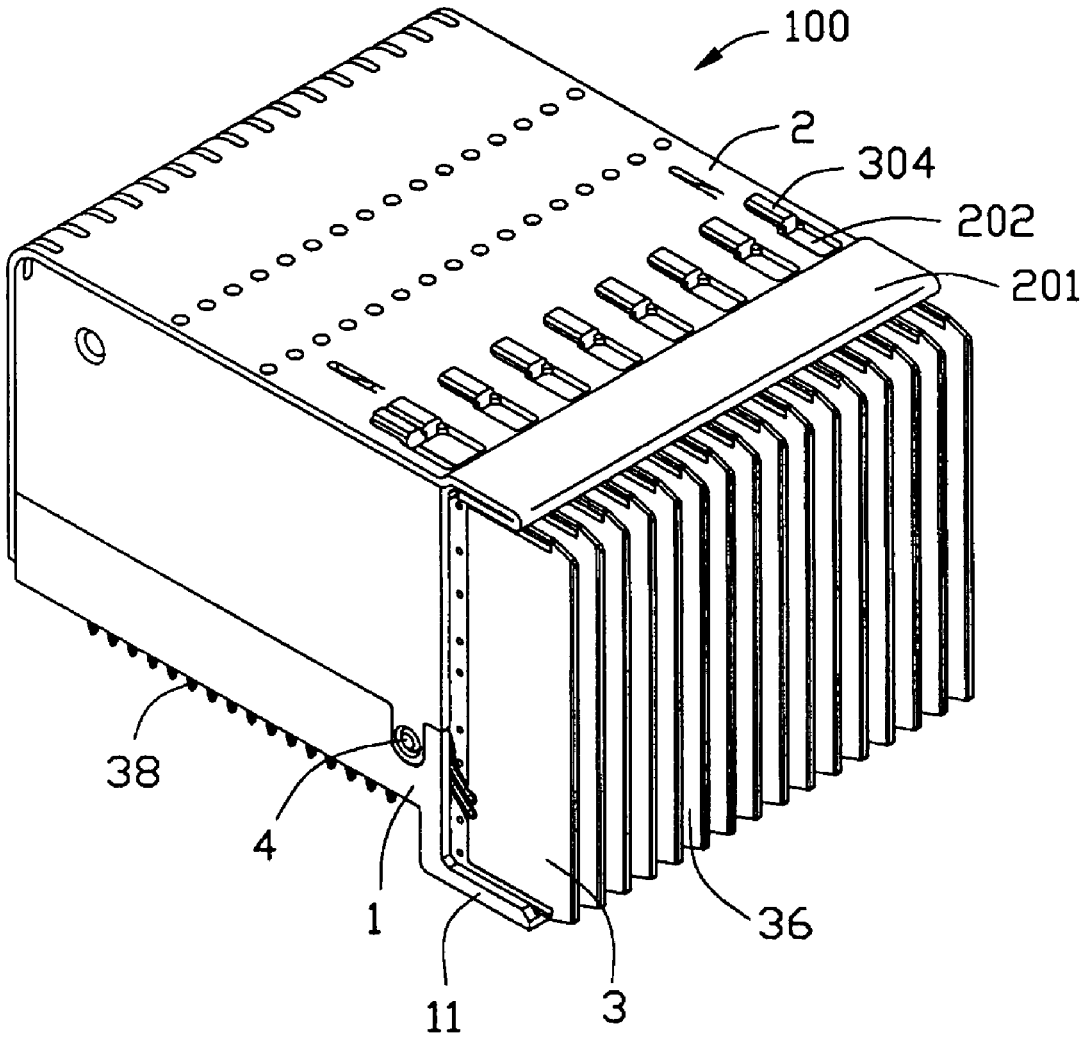
FIG. 1 is an assembled perspective view of an electrical connector in accordance with the present invention.
Figure 2:
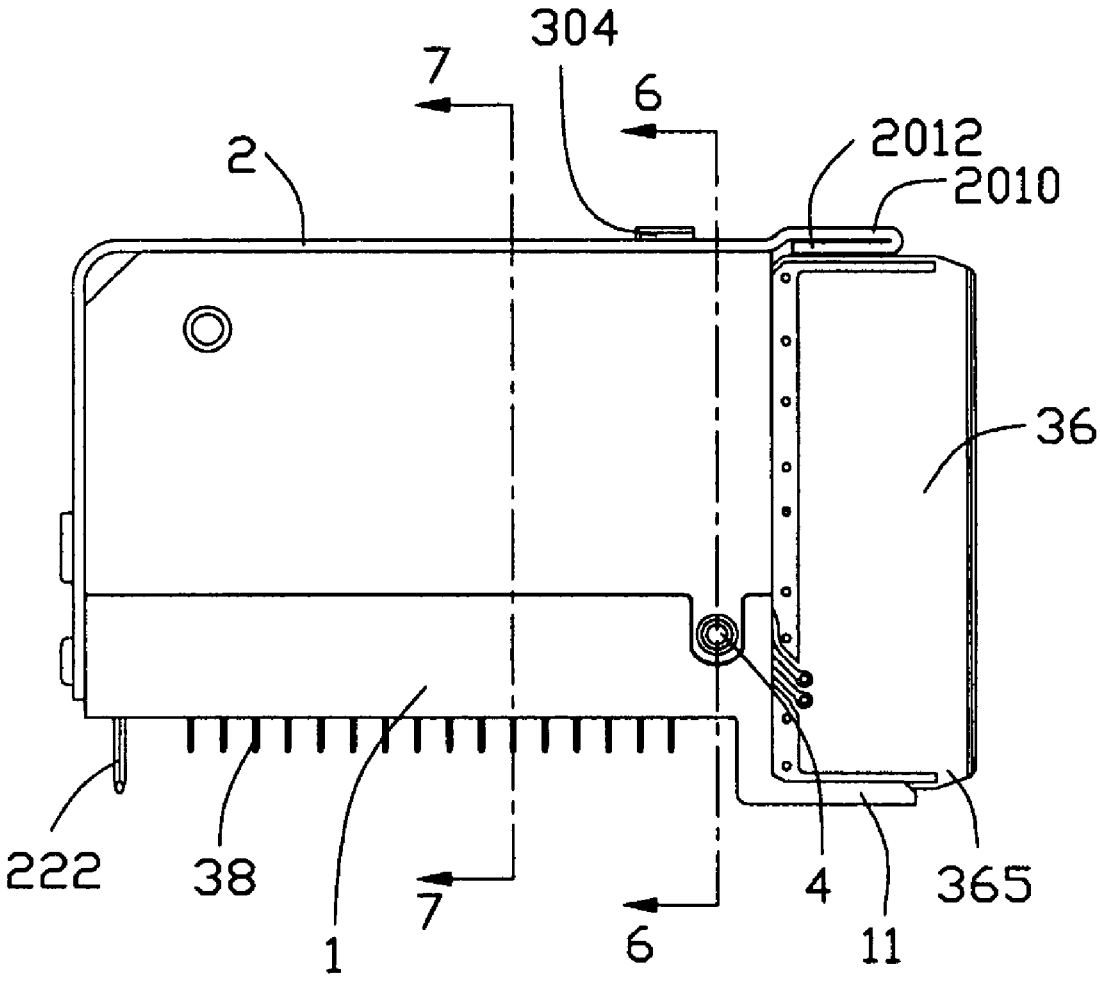
FIG. 2 is a side elevation view of the electrical connector shown in FIG. 1.
Figure 3:
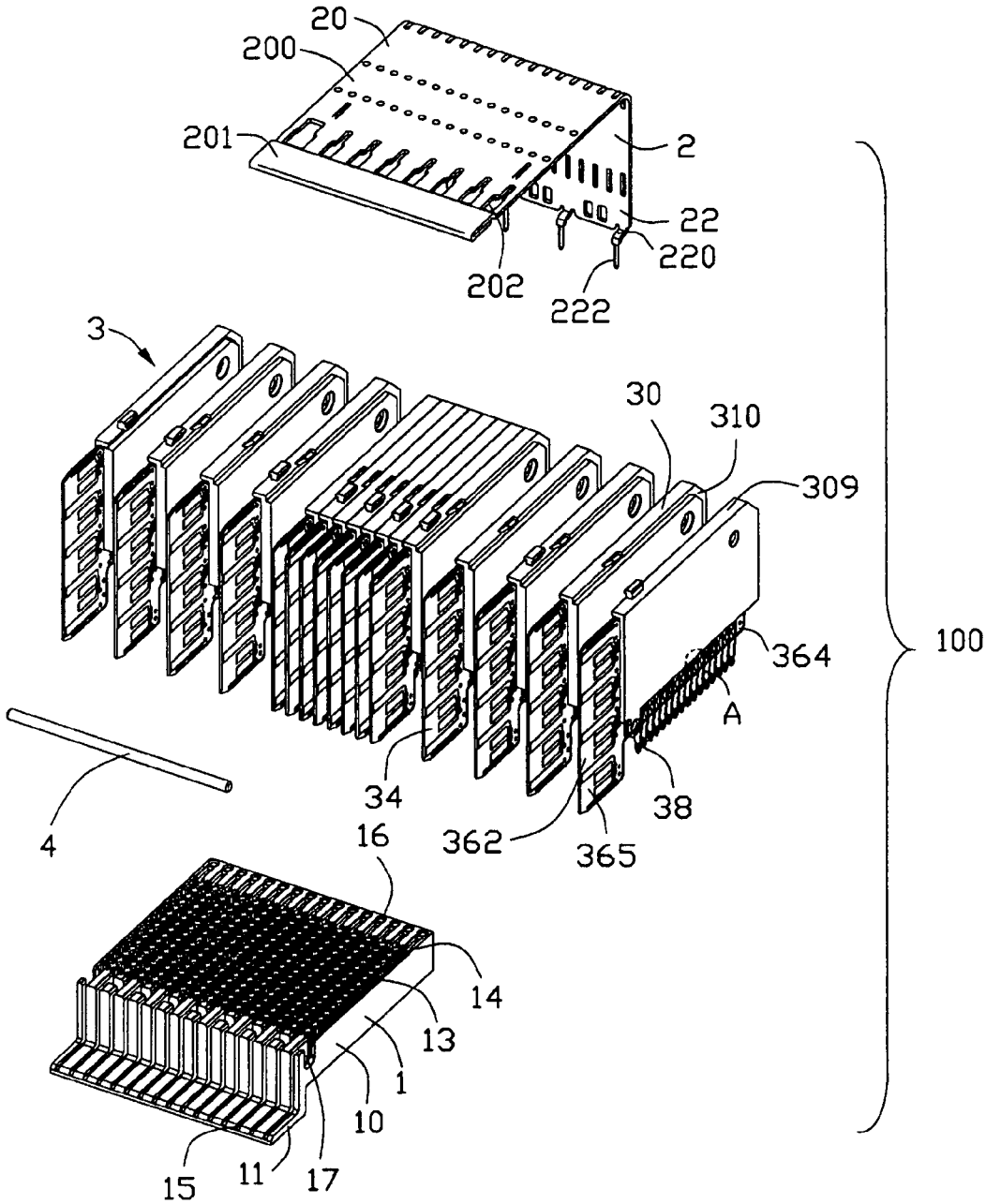
FIG. 3 is an exploded perspective view of the connector shown in FIG.

Referring to FIGS. 1, 2 and 3, an electrical connector 100 in accordance with the present invention comprises a unitary insulating housing 1, a metal stiffener 2, a plurality of individual circuit board modules 3 retained between the housing 1 and the metal stiffener 2, and an alignment pin 4 inserting through the circuit board modules 3.

The housing 1 includes a rectangular base 10 and a first shroud 11 extending forwardly from a lower portion of a front end of the base 10. The base 10 defines a plurality of parallel slots 13 extending along a longitudinal direction of the housing 1, and plural rows of passageways 14 communicating with corresponding slots 13 and penetrating through a bottom thereof. The first shroud 11 defines a plurality of grooves 15 aligned with corresponding slots 13. The housing 2 defines a row of holes 16 at a rear end thereof and a bore 17 laterally extending therethrough. It is noted that for the consideration of injection molding without requirement of the slide molds, the bore 17 is formed by the continuously alternately arranged upward and downward passages 172, 171 (FIG. 6), in the housing 2, which communicate with the exterior vertically and with the neighboring slots 13 laterally.

The metal stiffener 2 is stamped from a metal sheet and comprises a top plate 20 and a rear plate 22 extending downwardly from a rear edge of the top plate 20. The top plate 20 has a main body 200 and a second shroud 201 extending forwardly from the main body 200. The second shroud 201 includes an upper section 2010 extending forwardly from the main body 200 and a lower section 2012 bending rearwardly from a front edge of the upper section 2010. The upper and the lower sections 2010, 2012 are arranged to overlap each other. The main body 200 defines a plurality of slots 202 adjacent the second shroud 201. The rear plate 22 is formed with a plurality of fastening tabs 220 extending forwardly from a bottom edge thereof for being retained in corresponding recesses (not shown) of the housing 1 and a plurality of positioning fingers 222 extending downwardly from corresponding tabs 220 for insertion into corresponding through holes of a printed circuit board (PCB) to which the connector 100 is mounted for positioning the connector 100 on the PCB.

Figure 5:
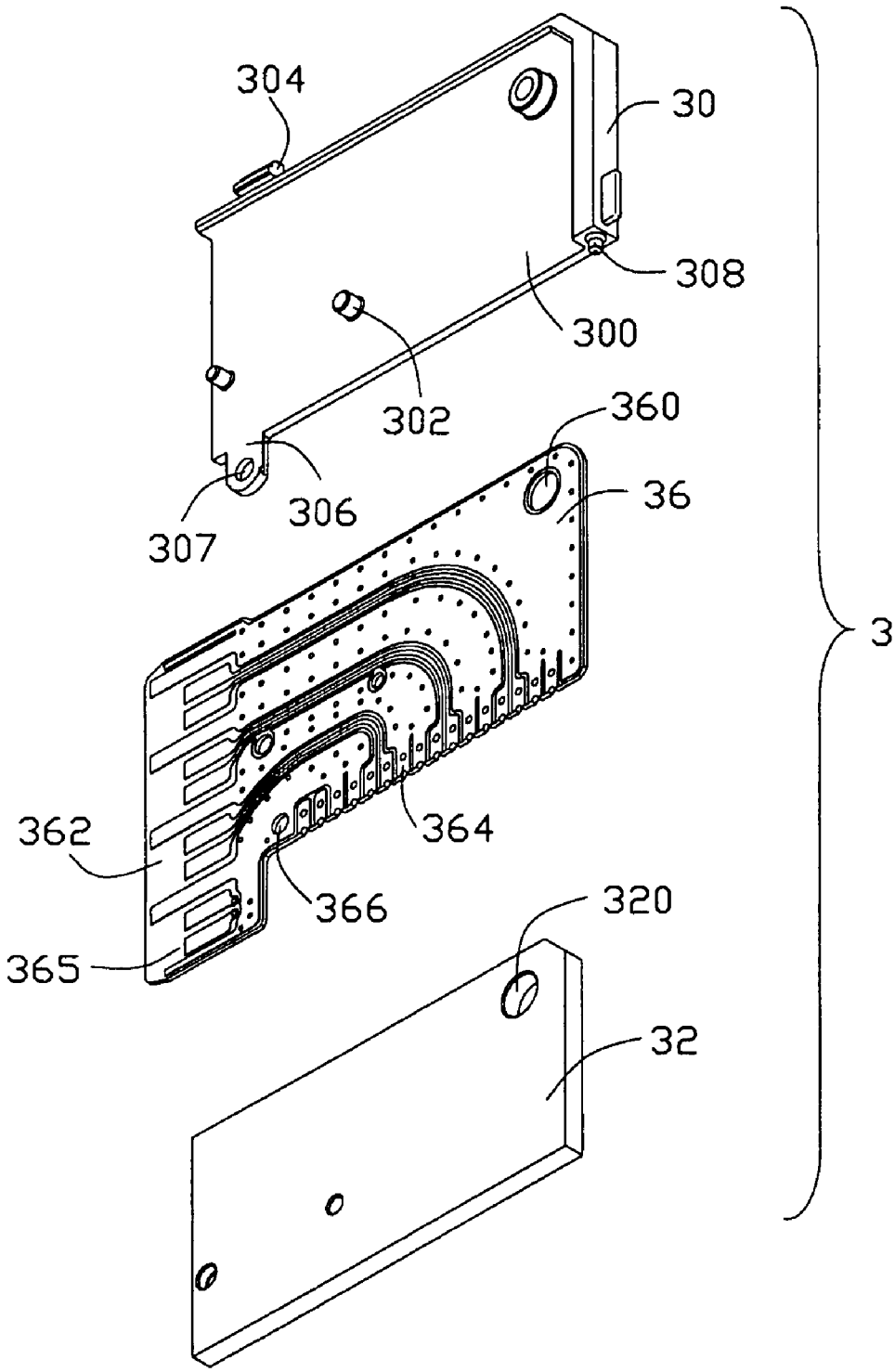
FIG. 5 is an exploded perspective view of a circuit board module used in the connector with press-fit contacts being omitted.

The individual circuit board modules 3 are side-by-side stacked. In a preferred embodiment, each one of the circuit board modules 3 is substantially identical in structure except for a left outermost one of FIG. 3. As best shown in FIG. 5, the left outermost circuit board module 3 comprises a dielectric spacer 30, a dielectric block 32 and a circuit board assembly 34 securely sandwiched between the dielectric spacer 30 and the dielectric block 32. The dielectric spacer 30 is a flat plate and defines a recess 300 in a first side thereof receiving the circuit board assembly 34. The dielectric spacer 30 includes a plurality of laterally extending posts 302 in the recess 300, a T-shaped protrusion 304 on a top edge thereof, a tab 306 with an opening 307 defined therein extending downwardly from a bottom edge adjacent a front end thereof, and a positioning pin 308 extending downwardly from the bottom edge adjacent a rear end thereof. The circuit board assembly 34 includes a circuit board 36 and a plurality of press-fit contacts 38 (shown in FIG. 3) electrically and mechanically connecting with the circuit board 36. The circuit board 36 defines a corresponding number of retention holes 360 receiving the posts 302 of the dielectric spacer 30 to thereby secure the circuit board assembly 34 with the dielectric spacer 30. The dielectric block 32 defines a corresponding number of through holes 320 receiving the posts 302 of the dielectric spacer 30 to thereby sandwich the circuit board assembly 34 between the dielectric spacer 30 and the dielectric block 32.

Referring again to FIG. 3, each of the other circuit board modules 3 has a structure substantially the same as the left outermost one except that the dielectric block 32 is not introduced and the recess 300 is defined in a second opposite side of the dielectric spacer 30. Every two adjacent circuit board modules 3 are side to side stackable with use of extended posts 309 (only one is shown) on one of the two adjacent dielectric spacers 30 and recessed holes 310 in another of the two adjacent dielectric spacers 30.

The circuit board 36 has a mating portion 362 extending beyond the front edge of the dielectric spacer 30 and a mounting portion 364 extending beyond the bottom edge of the dielectric spacer 30. The circuit board 36 includes a dielectric substrate made of conventional circuit board substrate material, such as FR4, and signal and grounding traces on the substrate. The signal and the grounding traces of the circuit board 36 provide electrical paths from the mating portion 362 to the mounting portion 364. Each of the circuit boards 36 defines a through hole 366 aligned with the bore 17 of the housing 1 and the opening 307 of the dielectric spacer 30. It is noted that the T-shaped protrusion 304 may be formed on every other dielectric spacer 30 rather than on each dielectric spacer 30.

Figure 6:
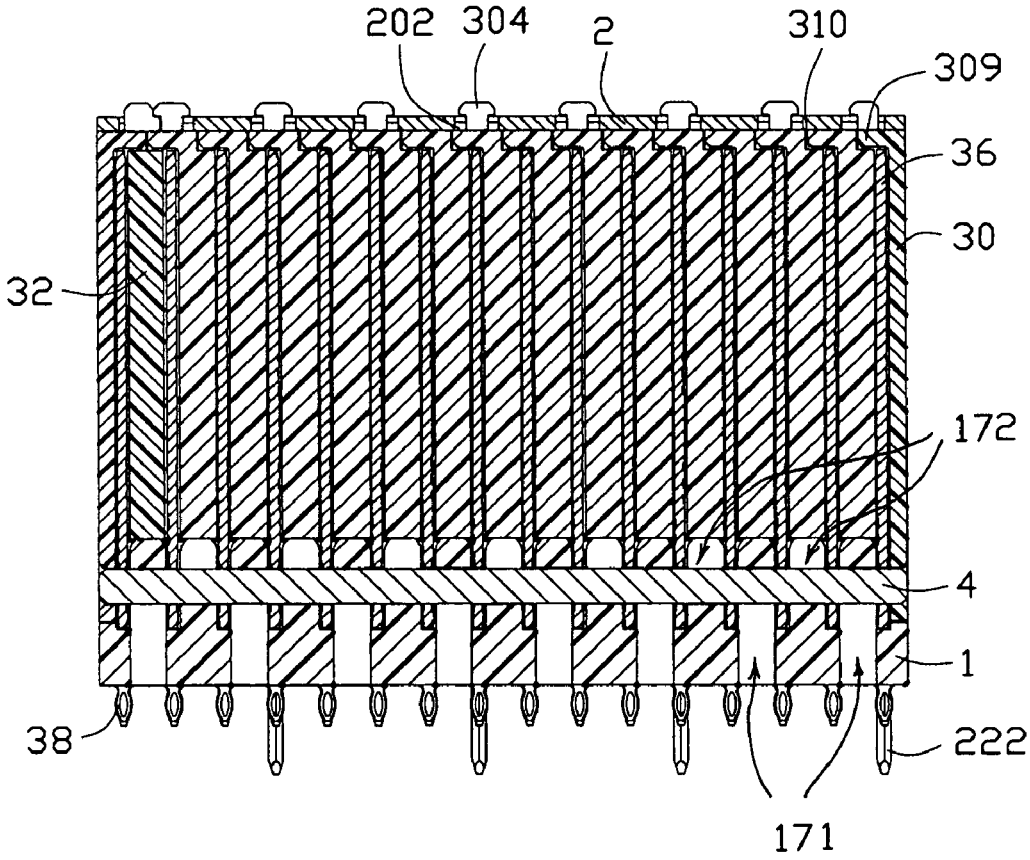
FIG. 6 is a cross-section view of the connector taken along line 6—6 of FIG. 2.
Figure 7:
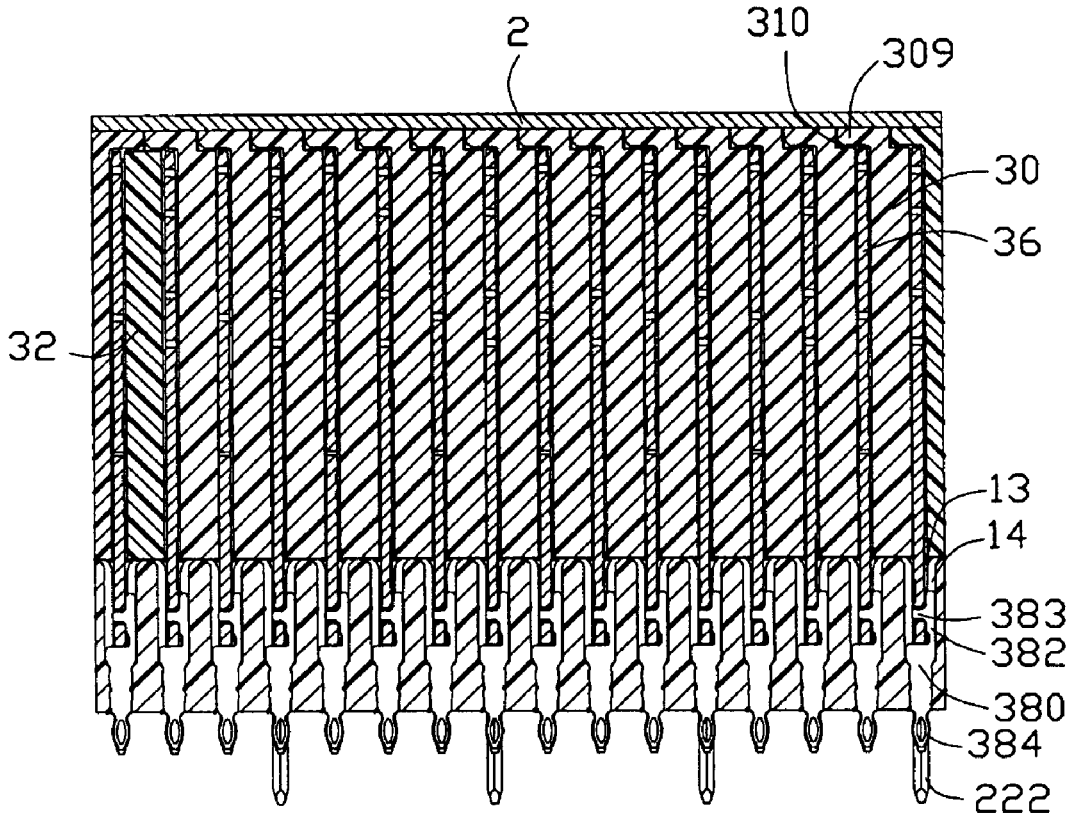
FIG. 7 is a cross-section view of the connector taken along line 7—7 of FIG. 2.

Referring to FIGS. 6 and 7 in conjunction with FIG. 3, the circuit board modules 3 are first installed in the metal stiffener 2 with the protrusions 304 received in corresponding slots 202 and then are assembled to the housing 1 by locating the positioning pins 308 in the holes 16 and inserting the mounting portions 364 into the slots 13. The press-fit contacts 38 are received in the passageways 14 of the housing 1 and extend beyond the bottom of the housing 1 for being press-fitted into corresponding plated through holes of the PCB. The circuit boards 36 have front, lower edges 365 received in the grooves 15 of the first shroud 11 of the housing 1. After the circuit board modules 3 are assembled to the housing 1, the alignment pin 4 inserts through the bore 17 of the housing 1, the openings 307 of the dielectric spacers 30 and the through holes 366 of the circuit boards 36, thereby providing an accurate position of the mating portions 362 of the circuit boards 36. The second shroud 201 of the metal stiffener 2 is parallel to and vertically spaced from the first shroud 11 of the housing 1. The mating portions 362 of the circuit boards 36 are disposed between the first shroud 11 and the second shroud 201. When the positioning fingers 222 of the metal stiffener 2 are electrically connected to grounding traces of the printed circuit board, the metal stiffener 2 thus functions as a shield member for EMI (Electro Magnetic Interference) protection.

Figure 8:
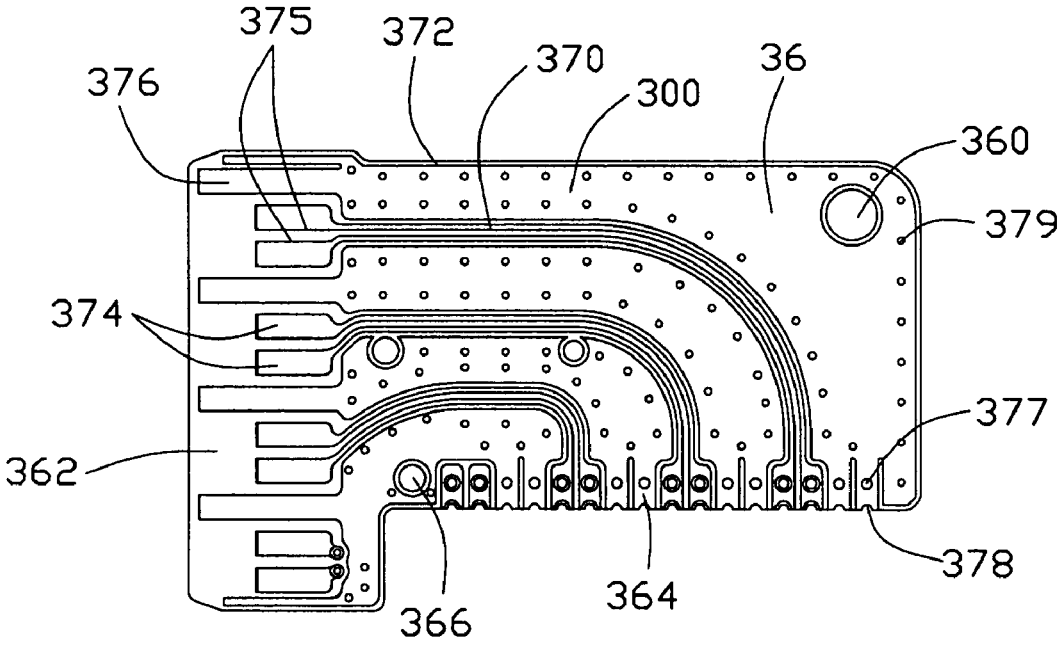
FIG. 8 is a first side elevation view of a circuit board that may be used in the connector.
Figure 9:
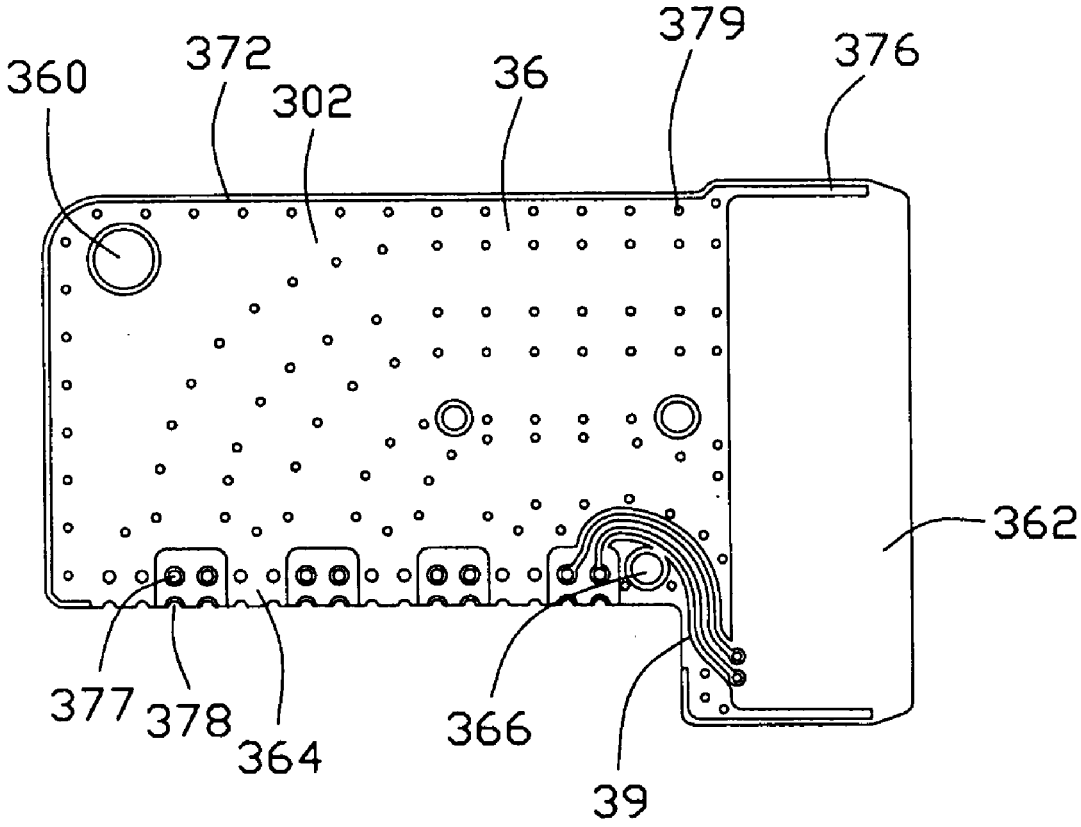
FIG. 9 is a second side elevation view of the circuit board.

FIGS. 8 and 9 show opposite faces of the circuit board 36 that may be used in the connector 100. On a first face 300 of each circuit board 36 are alternating signal traces 370 and grounding traces 372, and on a second face 302 of each circuit board 36 are only the grounding traces 372.

Each circuit board 36 has conductive pads on the mating portion 362 which are allocated as signal pads 374 and grounding pads 376. The signal pads 374 are electrically connected to the signal traces 370, and these pads 374 are all on the first face 300 of each circuit board 36. The grounding pads 376 are electrically connected to the grounding traces 372, and these pads 376 are disposed on the first face 300 and the second face 302 of each circuit board 36. Electrical connections between the grounding pads 376 on the opposite faces of the circuit board 36 are made by the grounding traces 372 through conductive vias 379.

The signal traces 370 are coupled to have plural differential pairs on the first face 300. Adjacent differential pairs of the signal traces 370 are separated by the grounding traces 372. The signal traces 370 of the differential pair extend from corresponding signal pads 374 adjacent innermost edges 375, i.e., the signal traces 370 of the differential pair are very closely spaced to have a relatively large distance between adjacent differential pairs, thereby enhancing reduction of crosstalk between adjacent differential pairs. The lowest differential pair has traces 39 on the second face 302 to reduce length and make trace routing easier.

Figure 4:
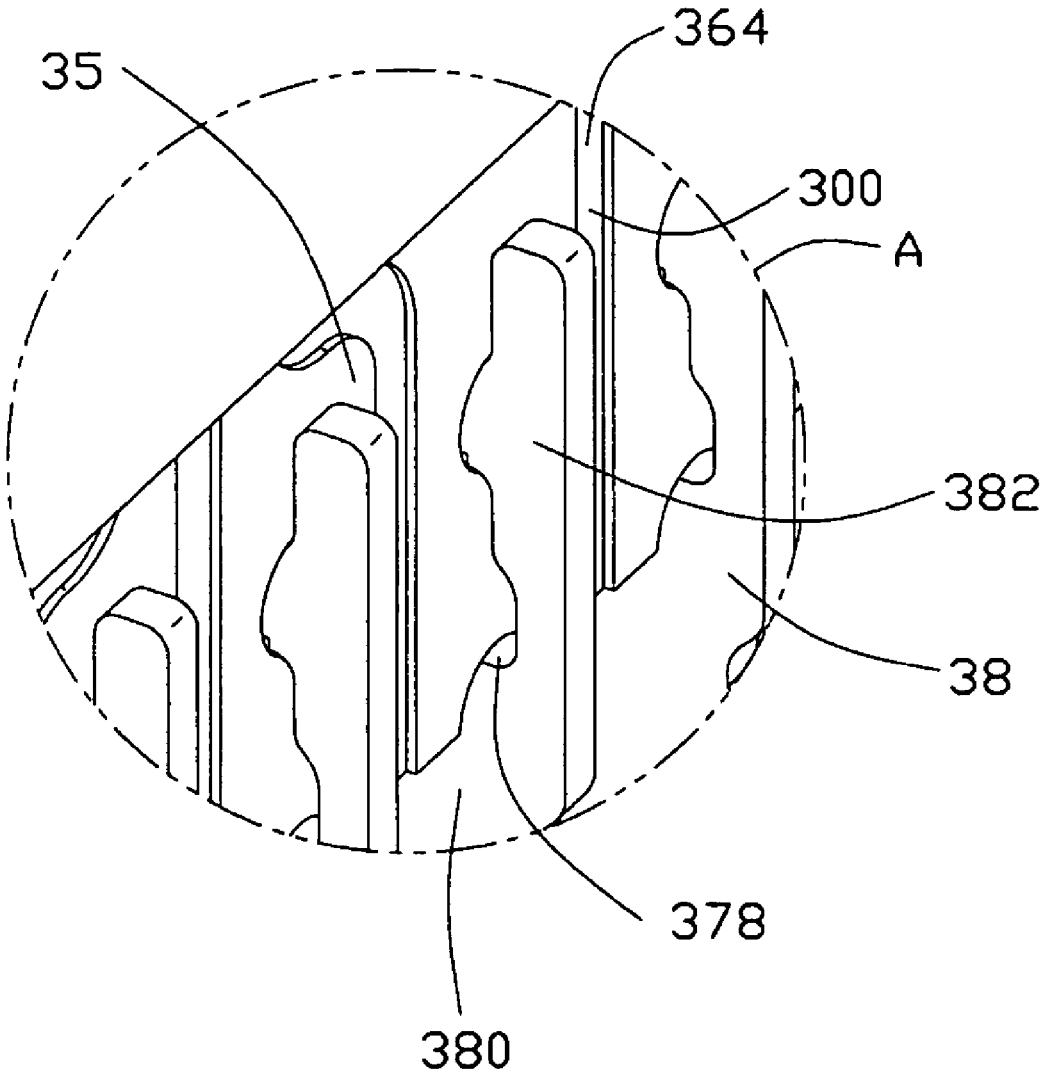
FIG. 4 is an enlarged view of a circled portion A of FIG. 3.

According to one aspect of the invention as shown in FIGS. 3 and 4, the press-fit contacts 38 are secured to the mounting portion 364 of the circuit board 36 by soldering, which will be described in detail hereinafter.

Figure 10:
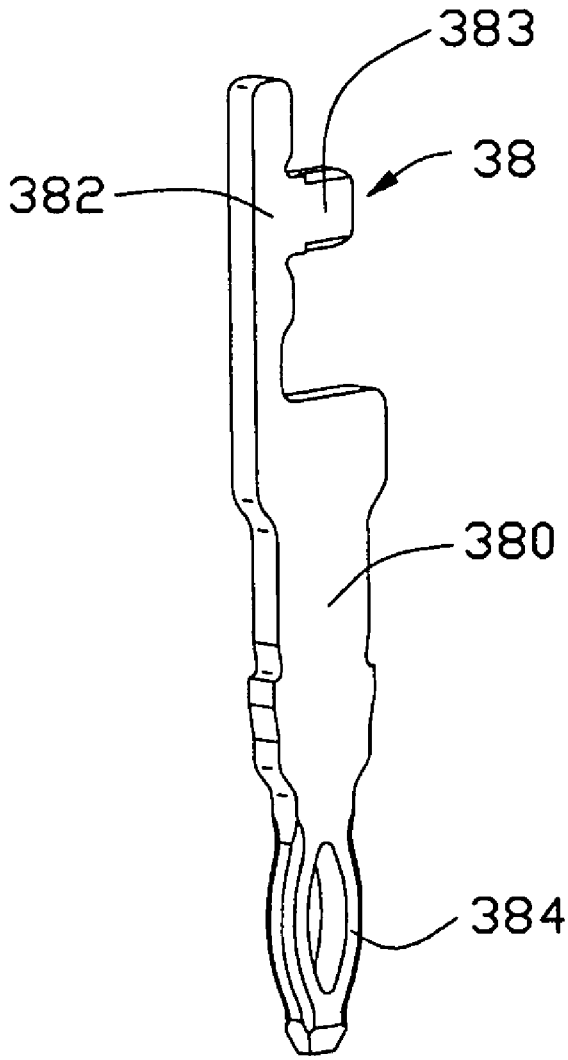
FIG. 10 is a perspective view of a contact used in the connector.

Referring to FIG. 10 in conjunction with FIG. 7, each press-fit contact 38 includes an intermediate portion 380 having an interference fit in a corresponding passageway 14 of the housing 1, a connecting portion 382 extending upwardly from an upper end of the intermediate portion 380 for surface mount soldering to the mounting portion 364 of the circuit board 36, and a compliant tail 384 extending downwardly from a lower end of the intermediate portion 380 for insertion into the plated through hole of the PCB. The connecting portion 382 is positioned adjacent a first side of the intermediate portion 380 and is formed with a solder section 383 extending toward an opposite second side of the intermediate portion 380 for through hole soldering to the mounting portion 364 of the circuit board 36.

Referring back to FIGS. 8 and 9, according to the invention, the mounting portion 364 of each circuit board 36 defines an upper row of plated through holes 377 for receiving the solder sections 383 of the press-fit contacts 38 and a lower row of half plated through holes 378 in a bottom edge thereof and aligned with corresponding plated through holes 377 for partially receiving the upper ends of the intermediate portions 380 of the press-fit contacts 38.

FIG. 4 shows the press-fit contacts 38 soldered to the mounting portion 364 of the circuit board 36. The first face 300 of the mounting portion 364 is coated with plural solder pastes 35 which are electrically connected to the corresponding signal and grounding traces 370, 372, respectively. The press-fit contacts 38 are placed on the solder pastes 35 with the solder sections 383 received in the plated through holes 377 and the upper ends of the intermediate portions 380 received in the half plated through holes 378. After the solder 35 is melt, interstitial space between the solder section 383 of the press-fit contact 38 and the corresponding plated through hole 377 of the circuit board 36 is filled with the solder 35. In addition, interstitial space between the intermediate portion 380 and the corresponding half plated through hole 378 of the circuit board 36 is also filled with the solder 35. Therefore, when the melting solder 35 is cooled and solidified, the press-fit contacts 38 are reliably connected with the mounting portion 364 of the circuit board 36, e.g., there is redundant solder connection between the circuit board 36 and the press-fit contact 38 by use of plated through hole 377 and the half plated through hole 378, whereby the circuit board 36 can withstand the compliant insertion forces of the press-fit contacts 38.

It is noted that the metal stiffener 2 in conjunction with the housing 1 obviate the need for a separate box or housing to hold the circuit board modules 3, thereby simplifying the connector 100. It is also noted that the first shroud 11 of the housing 1 and the second shroud 201 of the metal stiffener 2 commonly provide a guiding insertion of a complementary connector (not shown), thereby ensuring a correct and a reliable engagement between the connector 100 and the complementary connector.

It is understood that the circuit boards 36 can be directly retained by and between the metal stiffener 2 and the housing 1 without use of the dielectric spacers 30. Detailed descriptions of this arrangement are disclosed in U.S. patent application Ser. No. 10/651,932 (the '932 application), filed on Aug. 29, 2003 and entitled "ELECTRICAL CONNECTOR HAVING ENCHANCED ELECTRICAL PERFORMANCE". The disclosures of the '932 application are wholly incorporated herein by reference.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a unitary insulative housing including a base and a first shroud extending forwardly from the base, the base defining a plurality of parallel slots therein;

a plurality of parallelly arranged circuit boards, each circuit board having a mating portion for mating with a complementary connector and a contact attaching section with conductive traces thereon, the contact attaching sections being at least partially received in corresponding ones of the slots of the housing;

plural rows of contacts disposed communicatively around the slots, respectively, the contacts each having a section electrically and mechanically attached to corresponding ones of the conductive traces on the circuit boards; and a metal stiffener attached to the housing and comprising a second shroud vertically spaced from the first shroud, the circuit boards being retained by and between the metal stiffener and the housing, the mating portions of the circuit boards being disposed between the first shroud and the second shroud.

2. The electrical connector as claimed in claim 1, wherein the first shroud defines a plurality of grooves aligned with corresponding slots, and wherein the mating portions of the circuit boards have lower edges received in corresponding grooves.

3. The electrical connector as claimed in claim 1, wherein the second shroud is parallel to the first shroud.

4. The electrical connector as claimed in claim 3, wherein the metal stiffener comprises a top plate covering a top of the parallelly arranged circuit boards, the top plate including a main body with the second shroud extending forwardly therefrom.

5. The electrical connector as claimed in claim 4, wherein the second shroud includes an upper section extending forwardly from the main body and a lower section bending rearwardly from a front edge of the upper section, the upper and the lower sections being arranged to overlap with each other.

6. The electrical connector as claimed in claim 4, wherein the metal stiffener comprises a rear plate covering a rear of the housing and the circuit boards, the rear plate including positioning fingers for insertion into corresponding through holes of a printed circuit board.

7. The electrical connector as claimed in claim 4, further comprising plural dielectric spacers, and wherein each circuit board is assembled with a corresponding dielectric spacer to form a circuit board module.

8. The electrical connector as claimed in claim 7, wherein the metal stiffener defines a plurality of slots in the top plate adjacent the second shroud, and the dielectric spacers comprise a plurality of protrusions received in the slots to retain upper portions of the circuit board modules.

9. The electrical connector as claimed in claim 8, wherein the housing is vertically spaced from the top plate of the metal stiffener and retains lower portions of the circuit board modules.

10. The electrical connector as claimed in claim 7, wherein every two adjacent circuit board modules are side to side stackable with use of an extended post on one of the two adjacent dielectric spacers and a recessed hole in another of the two adjacent dielectric spacers.

11. The electrical connector as claimed in claim 7, wherein the dielectric spacer of each circuit board module includes a recess and a plurality of laterally extending posts in the recess, and the circuit board is received in the recess of the dielectric spacer and defines a corresponding number of holes receiving the posts.

12. The electrical connector as claimed in claim 7, wherein opposite outermost circuit board modules are arranged in such a manner that the dielectric spacers are located at outermost positions.

13. The electrical connector as claimed in claim 7, wherein the housing defines a row of holes adjacent a rear end thereof, and the dielectric spacers of the circuit board modules comprise a plurality of downwardly extending pins received in the holes.

14. The electrical connector as claimed in claim 7, further comprising an alignment pin, and wherein each of the circuit boards defines a through hole, and each of the dielectric spacers defines an opening aligned with the through hole, the alignment pin inserting through the housing, the through holes of the circuit boards and the openings of the dielectric spacers.

15. The electrical connector as claimed in claim 1, wherein the housing defines a plurality of passageways at opposite sides of each slot and extending through a bottom thereof, and the contacts are soldered to the lower portions of the corresponding circuit boards and extend beyond a bottom of the housing through the passageways.

16. The electrical connector as claimed in claim 1, wherein the contacts are attached to the contact attaching section of the circuit board before they are disposed in the slots of the insulative housing.

17. The electrical connector as claimed in claim 1, wherein the contacts are attached to the contact attaching section of the circuit board after they are disposed in the slots of the insulative housing.

18. An electrical connector comprising:

an insulative housing defining an elongated base extending along a first direction with therein a plurality of parallel slots each extending in a second direction perpendicular to said first direction;

a plurality of parallel circuit boards respectively disposed in the corresponding slots;

a plurality of contacts fastened to each corresponding circuit board and retained in corresponding passageways which communicate with the corresponding slot;

said circuit boards defining aligned through holes, and the housing defining a through bore in alignment with said through holes in the second direction; and an alignment pin extending through said bore and said through holes in said second direction; wherein said bore is formed by alternately arranged upward and downward passages which communicate with an exterior in a third direction which is perpendicular to both said first and second directions.

19. The connector as claimed in claim 18, wherein said passages communicate with the corresponding neighboring slots in said second direction, respectively.

20. An electrical connector comprising:

an insulative housing defining an elongated base extending along a first direction with therein a plurality of parallel slots each extending in a second direction perpendicular to said first direction;

a plurality of parallel circuit boards respectively disposed in the corresponding slots, a front portion of each of said circuit boards exposed out of the corresponding slot in said second direction;

a plurality of contacts fastened to each corresponding circuit board and retained in corresponding passageways which communicate with the corresponding slot; and a metallic stiffener located above the housing; wherein the housing further includes a first shroud and the stiffener further includes a second shroud opposite to said first shroud to commonly define a space receiving said front portions of the circuit boards in a third direction which is perpendicular to both said first direction and said second direction.

21. The connector as claimed in claim 20, wherein said first shroud defines a plurality of grooves in alignment with the corresponding slots, respectively, in said second direction.

* * * * *